US011560162B2

(12) United States Patent
Schoedl et al.

(10) Patent No.: US 11,560,162 B2
(45) Date of Patent: Jan. 24, 2023

(54) RAILCAR ENERGY ABSORPTION SYSTEM AND RELATED METHOD FOR ABSORBING ENERGY ON A RAILCAR

(71) Applicant: Miner Enterprises, Inc., Geneva, IL (US)

(72) Inventors: Erich A. Schoedl, Sugar Grove, IL (US); Andy R. Kries, Elgin, IL (US); Bradley J. Haymond, Elgin, IL (US); Kenneth A. James, West Chicago, IL (US)

(73) Assignee: MINER ENTERPRISES, INC., Geneva, IL (US)

( * ) Notice: Subject to any disclaimer, the term of this patent is extended or adjusted under 35 U.S.C. 154(b) by 386 days.

(21) Appl. No.: 16/856,592

(22) Filed: Apr. 23, 2020

(65) Prior Publication Data

US 2020/0385033 A1 Dec. 10, 2020

Related U.S. Application Data

(60) Provisional application No. 62/857,560, filed on Jun. 5, 2019.

(51) Int. Cl.
*B61G 11/12* (2006.01)
*B61G 11/18* (2006.01)

(52) U.S. Cl.
CPC ..... *B61G 11/12* (2013.01); *B61G 11/18* (2013.01)

(58) Field of Classification Search
CPC ... B61G 7/00; B61G 7/10; B61G 9/04; B61G 9/06; B61G 9/12; B61G 9/22; B61G 9/24; B61G 11/00; B61G 11/12; B61G 11/18
See application file for complete search history.

(56) References Cited

U.S. PATENT DOCUMENTS 461,443 A 10/1891 Miner
2,390,496 A 12/1945 Campbell
(Continued)

OTHER PUBLICATIONS

International Searching Authority; International Search Report regarding International PCT patent application PCT/US20/30361; dated Jul. 23, 2020. 3 pages.
(Continued)

*Primary Examiner* — Robert J McCarry, Jr.
(74) *Attorney, Agent, or Firm* — Law Office of John W. Harbst

(57) ABSTRACT

An energy absorption system for a railcar having an elongated sill with front and rear stops defining a pocket therebetween. To facilitate use of known railcar structures, the energy absorption system can be used in combination with a railcar also having a sill with center stops disposed between the front and rear stops. A coupler having a head portion and a shank portion is arranged in operable combination with the energy absorption system. The energy absorption system also includes a first cushioning assembly positioned in the sill pocket. A first follower is urged toward and engageable with the front stops under the influence of the first cushioning assembly and is operably engageable with a free end of the shank portion of the coupler. A second cushioning assembly is positioned in generally axial alignment with first cushioning assembly. A second follower is positioned and normally urged by the energy absorption system toward and configured to engage with the center stops. An axially elongated yoke encompasses the first and second cushioning assemblies, terminates in an open forward end, and is coupled to the shank portion of the coupler. The first and second cushioning assemblies act in series relative to each other to absorb and cushion impact forces directed against them when the energy absorption system operates in a buff direction. Advantageously, the second
(Continued)

follower acts in concert with the center stops and the second cushioning assembly to minimize excessive system cycles while better dissipating train action energy when the energy absorption system operates in a draft direction.

18 Claims, 10 Drawing Sheets

(56) References Cited

U.S. PATENT DOCUMENTS

| | | | | |
|---|---|---|---|---|
| 2,825,472 | A | 3/1958 | Peterson | |
| 3,197,037 | A | 7/1965 | Willison | |
| 5,312,007 | A | 5/1994 | Kaufhold et al. | |
| 6,199,708 | B1 | 3/2001 | Monaco | |
| 6,360,906 | B1 * | 3/2002 | Kaufhold | B61G 9/06 213/32 C |
| 2016/0137212 | A1 * | 5/2016 | James | B61G 7/10 213/75 R |
| 2018/0065649 | A1 * | 3/2018 | Clark | B61G 9/04 |

OTHER PUBLICATIONS

International Searching Authority; Written Opinion of the InternationalSearchintg Authority regarding International PCT patent application PCT/US20/30361; dated Jul. 23, 2020; 7 pag.

* cited by examiner

RAILCAR ENERGY ABSORPTION SYSTEM AND RELATED METHOD FOR ABSORBING ENERGY ON A RAILCAR

RELATED APPLICATION

This patent application relates to a co-pending and co-assigned U.S. PROVISIONAL patent application, namely U.S. patent application Ser. No. 62,1857,560 filed Jun. 5, 2019; the entirety of which is incorporated herein by reference.

FIELD OF THE INVENTION DISCLOSURE

This invention disclosure generally relates to railroad car and, more specifically, to a system on a rail car for absorbing both buff and draft forces normally encountered by railcars during their in-service operation and a related method for absorbing energy on a railcar.

BACKGROUND

When a train consist is assembled in a rail yard, railcars run into and collide with each other to couple them to each other. Since "time is money", the speed at which the railcars are coupled has significantly increased. Moreover, and because of their increased capacity, railcars are heavier than before. These two factors and others have resulted in increased damages to the railcars when they collide with each other and, frequently, the lading carried with such railcars.

As railroad car designers/builders continuing their efforts at reducing the weight of their designs, they have also identified a need and desire to protect the integrity of the railcar due to the excessive longitudinal loads/forces being placed thereon, especially as the railcars are coupled to each other. Whereas, such longitudinal loads/forces on the cars frequently exceed the design load limits set by the American Association of Railcars ("AAR").

Providing an energy absorption system at opposed ends of each railcar has been long known in the art. In some applications, the energy absorption system at opposed ends of the ear is captured within a defined space provided between front and rear pairs of stops arranged in operable combination with a centersill at each end of the railcar. Also, and once installed into operable combination with a railcar, the energy absorption system at opposed ends of the railcar is expected to yield energy absorption capabilities for the railcar over an extended period of time which, depending upon the level of service wherein the railcar is employed, can last for many years if not decades. Such energy absorption systems can typically be classified into multiple groups. In one form, an energy absorption system can include a type of hydraulic dampener for reducing the energy directed against the railcar. Another form of energy absorption system uses steel springs for reducing the energy directed against the railcar. Yet another form a of energy absorption system utilizes a series of axially stacked elastomeric pads for absorbing and dampening the energy directed against the railcar. Still another type or form of energy absorption system utilizes a friction clutch assembly arranged in operable combination with axially stacked elastomeric pads for absorbing and dampening the energy directed against the railcar.

The impacts occurring during the "make-up" of a train consist and during in-service train action subject the energy absorption system at opposed ends of the railcar to repeated buff impacts. In-service action also subjects the energy absorption system at opposed ends of the railcar to both repeated buff and draft events. The impacts associated with these events are transmitted from the couplers to the respective energy absorbing system or cushioning assembly and, ultimately, to the railcar body. That is, as the couplers are pushed and pilled in opposite longitudinal directions be it during in-service action and/or during the "make-up" of the train consist, such movements although muted by some degree by the cushioning assembly, are translated to the railcar body.

While use of a cushioning assembly in the form of a hydraulic dampener at opposed ends of the railcar offers certain advantages, such a cushioning assembly, however, is not without problems. Keeping in mind the service life of a railcar cushioning assembly can extend over several years, repeated longitudinal translations and reciprocations of an extended rod or member forming an essential part of the hydraulic dampener quickly and adversely wears on and, ultimately, destroys the sealing structure required with such a hydraulic dampener whereby minimizing its ability to provide railcar protection. Following continued use, a cushioning assembly in the form of a hydraulic dampener offers minimal draft protection. Moreover, and because of the design thereof, utilizing a cushioning assembly in the form of a hydraulic dampener furthermore requires use of a pair of center stops disposed proximately midway between the front stops and rear stops and arranged in operable combination with the centersill at both ends of the railcar. Also, the longitudinal distance between the front and rear pairs of stops on the centersill, wherein the hydraulics for such a cushioning assembly may be disposed, can be significantly greater than in other cushioning assembly arrangements.

A cushioning assembly which purely utilizes steel springs has many benefits. As will be appreciated by those skilled in the art, while serving to cushion the energy directed against such a cushioning assembly, use of steel springs in operable combination with a cushioning assembly offers little in the way of absorbing any of the energy directed against the cushioning assembly thereby returning that energy back through the train consist.

As mentioned, cushioning assemblies utilizing an axial stack of elastomeric pads to cushion the energy directed against the railcar are also known. Advantageously, and besides the benefits of cushioning the energy directed against the railcar, a cushioning assembly utilizing an axial stack of elastomeric pads furthermore yields the benefit of having at least a portion of the energy directed against the railcar being absorbed by the elastomeric pads. Unfortunately, and largely because of the both buff and draft directional forces being repeatedly applied to the cushioning assembly, such cushioning assemblies, especially when used in combination with today's railcars whereupon higher energy is being directed against them, have lesser degree of effectiveness to impact forces.

Because of the relatively high energy environment wherein such cushioning units are being used, a cushioning assembly which utilizes a friction clutch assembly arranged in operable combination with axially stacked elastomeric pads has proven very beneficial. These cushioning assemblies having a friction clutch arranged in operable combination therewith have been known to advantageously absorb high levels of energy imparted thereto. In some applications, such cushioning assemblies have advantageously been used in a tandem arrangement relative to each other to increase the level of energy which can be cushioned by such an arrangement.

These Applicants recognized and realized how particularly beneficial it could be if a purely mechanical energy absorption system could be used to replace the heretofore known cushioning assembly utilizing hydraulics. Such an energy absorption system can be beneficially used to cushion and absorb higher energy typically absorbed and cushioned by an energy absorption system utilizing hydraulics while eliminating the leakage problems known with such hydraulic systems.

Unfortunately, the pair of center stops required with a hydraulic cushioning assembly complicates simply switching a purely mechanical cushioning assembly for a hydraulic cushioning assembly. Applicants have found the pair of center stops required with a cushioning assembly using hydraulics structurally interferes with a design of a cushioning assembly utilizing other types of cushioning assemblies. The elongated space between the front and rear pairs of stops associated with a railcar which utilizes a cushioning assembly with a hydraulic unit presents other problems.

Simply removing the pair of center stops on the centersill to accommodate other types of cushioning assemblies has proven, for several reasons, particularly problematical. First, the expense involved with having to remove the pairs of center stops practically prohibits such an approach. Second, the pairs of center stops, inherently required to be used with any cushioning assembly utilizing hydraulics, are typically secured as by welding the center stops to the centersill of the railcar. As such, removal of the center stops, inherently required with any cushioning assembly utilizing hydraulics, requires cutting the pairs of stops from the centersill. As will be apparent to those skilled in the art, cutting both center stops from the centersill can considerably weaken the centersill of the railcar. Also, having to remove the pair of center stops from the sill to accommodate a cushioning assembly having a different design requires extensive time and efforts to effect such ends. For these and other reasons, simply replacing a cushioning assembly which utilizes hydraulics is far more complicated that it may initially appear.

It is also known to arrange a yoke in combination with the cushioning assembly. Typically, the yoke includes a back wall interconnected to top and bottom walls extending generally parallel to each other and toward an open end of the yoke. The cushioning assembly is typically sandwiched between the top and bottom walls of the yoke with a follower disposed toward a forward end of the cushioning assembly. The forward open end of the yoke is operably coupled to a railcar coupler which axially extends away from the cushioning assembly at each end of the railcar so as to allow adjacent railcars to be coupled to each other. Toward the open end thereof, the yoke is articulately connected to the railcar coupler through a suitable pin or key.

In buff events, a rear or butt end of a shank portion on the coupler moves axially inward and presses against the follower thus pushing the follower and cushioning assembly toward the pair of rear stops on the centersill. As the coupler and follower move under the influence of a buff event, a portion of the load or impact event is absorbed and dissipated by the cushioning assembly.

In draft events, unavoidable slack between adjacent but coupled railcars is taken up beginning at a starting or locomotive end of the train consist and ending at the other end of the train consist. As a result of the slack being progressively taken up, the speed difference between the railcars increases as the slack inherent with each railcar coupling at each end of the railcar in the train consist is taken up, with the resultant increase in draft events on the cushioning system. For example, when a locomotive on a train consist of railcars initially begins to move from a stopped or at rest position, there may be 100 inches of slack between the 50 or so pairs of couplings. This slack is taken up progressively by each pair of joined railcar couplings in the train consist. After the slack of the railcar coupling joining the last railcar to the remainder of the train consist is taken up, the next to the last railcar may be moving a few miles per hour. Given the above, it will be appreciated, the slack in the railcar couplers near the locomotive is taken up very rapidly while those railcars near the locomotive are subject to very high energy events being placed thereon. Such large energy events are capable of damaging railcar structures and sometimes the lading in the railcar.

Thus, there is a need and continuing desire for a railcar energy absorption system which is useful in both buff and draft directions to absorb and dissipate the relative high energies which are realized between coupled railcars throughout their operation.

SUMMARY

In view of the above and in accordance with one aspect of this invention disclosure, there is provided an energy absorption system on a railcar having an axially elongated centersill with a pair of front stops and a pair of rear stops defining an elongated pocket therebetween. To facilitate use of known railcar structures, the energy absorption system of this invention disclosure is usable in combination with a railcar having a centersill with a pair of center stops disposed between the pair of front stops and the pair of rear stops. A coupler having a head portion and a shank portion is arranged in operable combination with the energy absorption system. The head portion of the coupler axially extends beyond an end of the centersill. In one embodiment, the energy absorption system includes a first cushioning assembly positioned in the pocket of said centersill between the pair of front stops and the pair of center stops. The first cushioning assembly includes a housing, a plunger arranged for axial sliding movements within an open end of said housing, and a resilient spring for consistently urging the plunger toward an extended position relative to the housing. A first follower is positioned in the pocket of the centersill and is normally urged toward and engageable with the front pair of stops under the influence of the spring of the first cushioning assembly. The first follower is operably engageable with a free end of the shank portion of the coupler.

According to the this aspect of the invention disclosure, the energy absorption system also includes a second cushioning assembly positioned in the pocket of the centersill to the rear of the first cushioning assembly between the pair of center stops and the pair of rear stops. The second cushioning assembly includes a housing, a clutch system arranged for axial sliding movements within an open end of the second cushioning assembly housing, and a resilient spring for consistently urging the plunger of the second cushioning assembly toward an extended position relative to the housing of the second cushioning assembly. A second follower is positioned in the pocket and normally urged toward and configured to engage with the center pair of stops under the influence of the spring of said second cushioning assembly.

Furthermore, the energy absorption system also includes an axially elongated yoke having a back wall engageable with a rear end of the second cushioning assembly along with top and bottom walls which extend forwardly from the back wall so as to encompass the first and second cushioning assemblies therebetween. The yoke terminates in an open forward end so as to allow the yoke to be coupled to the shank portion of the coupler.

With the present invention disclosure, the first and second cushioning assemblies act in series relative to each other to absorb and cushion impact forces directed against them when the energy absorption system operates in a buff direction. Advantageously, the second follower acts in concert with the pair of center stops and the second cushioning assembly to operably isolate the first cushioning assembly from draft events to minimize excessive draft travel and better dissipate rebound energy.

In one form, the first and second cushioning assemblies differ in their energy absorption capabilities. In one form, the second follower has a generally T-shaped configuration when viewed from a top thereof. A forward end of the second follower is preferably urged toward and engages a rear end of the housing of the first cushioning assembly. In a preferred embodiment, the housing of the first cushioning assembly is configured to fit laterally between the pair of center stops.

In a preferred embodiment, an operable overall thickness of the second follower can vary to allow the railcar energy system to be used in various railcars having different size pockets between the front pair of stops and the rear pair of stops. In one form, the energy absorption system of this invention disclosure has a combined travel in a buff direction of about 7.25 inches and a total travel in a draft direction of about 4.75 inches limited by the second cushioning assembly.

In one form, the housing of both the first cushioning assembly and the second cushioning assembly each have a closed end and an open end. In this embodiment, the yoke is movable relative to the housing of both the first cushioning assembly and the second cushioning assembly.

According to another aspect of this invention disclosure, there is provided a method for absorbing energy on a railcar having an axially elongated centersill with a pair of front stops and a pair of rear stops defining an elongated pocket therebetween. The centersill also has a pair of center stops disposed between the pair of front stops and the pair of rear stops. The railcar in which the present invention disclosure finds utility also has a coupler having a head portion and a shank portion. The head portion of the coupler axially extends beyond an end of the centersill. The method comprises the steps of: arranging an energy absorption system within the elongated pocket defined between the first pair of front stops the pair of rear stops on the centersill. The energy absorption system includes a first cushioning assembly positioned in the pocket of the centersill between the pair of front stops and the pair of center stops. The first cushioning assembly includes a housing, a plunger arranged for axial sliding movements within an open end of the housing, and a resilient spring for consistently urging the plunger toward an extended position relative to the first cushioning assembly housing.

Another step in the method comprises: arranging a first follower in the pocket of the centersill such that the first follower is urged toward and engageable with the front pair of stops under the influence of the spring of the first cushioning assembly. The first follower is operably engageable with a free-end of the shank portion of the coupler.

According to this aspect of the invention disclosure, another step in the method comprises: configuring a second cushioning assembly to fit in the pocket of the centersill between the pair of center stops and the pair of rear stops. The second cushioning assembly includes a housing, a clutch arranged for axial sliding movements within an open end of the housing of the second cushioning assembly, and a resilient spring for consistently urging the clutch of the second cushioning assembly toward an extended position relative to the housing of the second cushioning assembly.

The method also comprises the step of: arranging a second follower in the pocket of the centersill such that the second follower is urged toward and is configured to engage with the center pair of stops under the influence of the spring of the second cushioning assembly.

The method further includes the step of: arranging an axially elongated yoke having a back wall along with top and bottom walls which extend forwardly from the back wall such that the top and bottom walls of the yoke entrap the first and second cushioning assemblies therebetween and terminate in an open forward end and is coupled to the shank portion of said coupler. The back wall of the yoke engages with a rear end of the second cushioning assembly when the coupler is pulled in draft.

According to this aspect of the invention disclosure, the first and second cushioning assemblies act in series relative to each other to absorb and cushion impact forces directed against them when the energy absorption system operates in a buff direction. When the energy absorption system operates in a draft direction, however, the second follower acts in concert with the pair of center stops and the second cushioning assembly to operably limit the run-out travel of the train consist while limiting the compression cycles of the energy absorption system in the draft direction to improve train handling.

In one embodiment, the energy absorption capabilities of the first and second cushioning assemblies differ. In a preferred embodiment, the method for absorbing energy on the railcar further includes the step of: configuring the second follower such that it has a generally T-shape when viewed from a top thereof. In one form, the method for absorbing energy on the railcar can also include the step of: designing the second follower such that a forward end of the second follower engages an end of the housing of the first cushioning assembly after the first and second cushioning assemblies are arranged in operative cooperation relative to each other.

In one embodiment, the method for absorbing energy on a railcar can further include the step of: using various second followers having varying thicknesses to accommodate railcars having different size pockets between the front pair of stops and the rear pair of stops. The method for absorbing energy on a railcar preferably includes the further step of: configuring each housing of the first cushioning assembly and the second cushioning assembly with a closed end and an open end. Preferably, the method for absorbing energy on a railcar further comprises the step of: allowing the yoke to move relative to the housing of both the first cushioning assembly and the second cushioning assembly.

DETAILED DESCRIPTION

Figure 1:
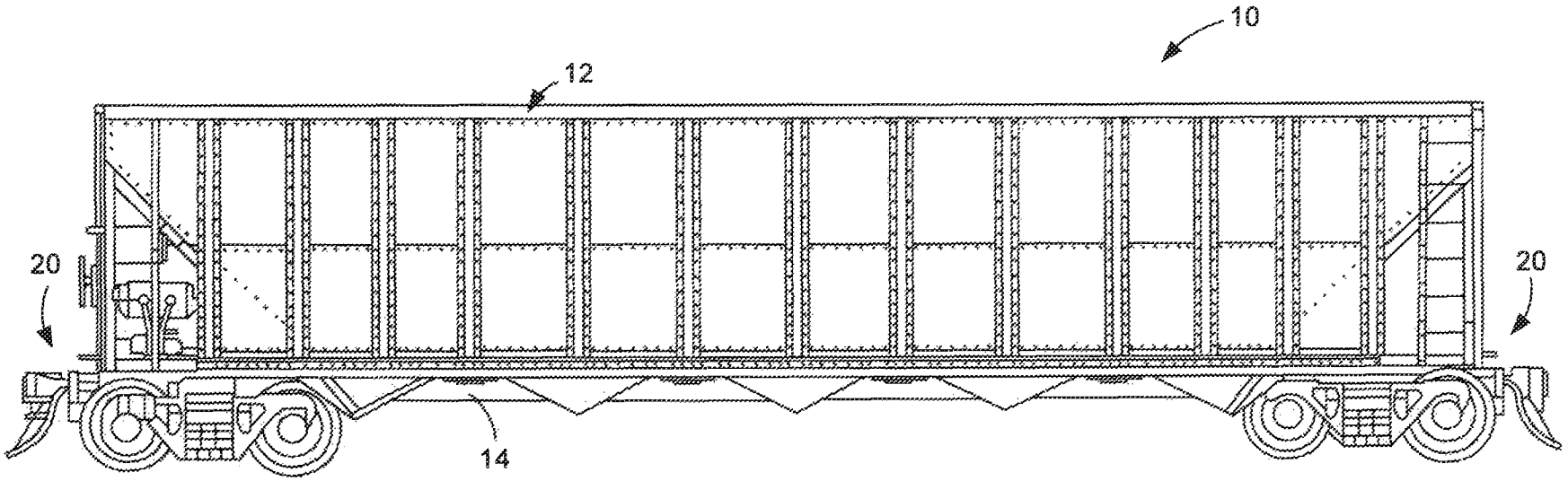
FIG. 1 is a side view of a railcar embodying principals and teachings of the present invention disclosure.

While this invention disclosure is susceptible of embodiment in various forms, there is shown in the drawings and will hereinafter be described preferred embodiments, with the understanding the present invention disclosure is to be considered as setting forth exemplifications of the disclosure which are not intended to limit the invention disclosure to the specific embodiments illustrated and described.

Figure 2:
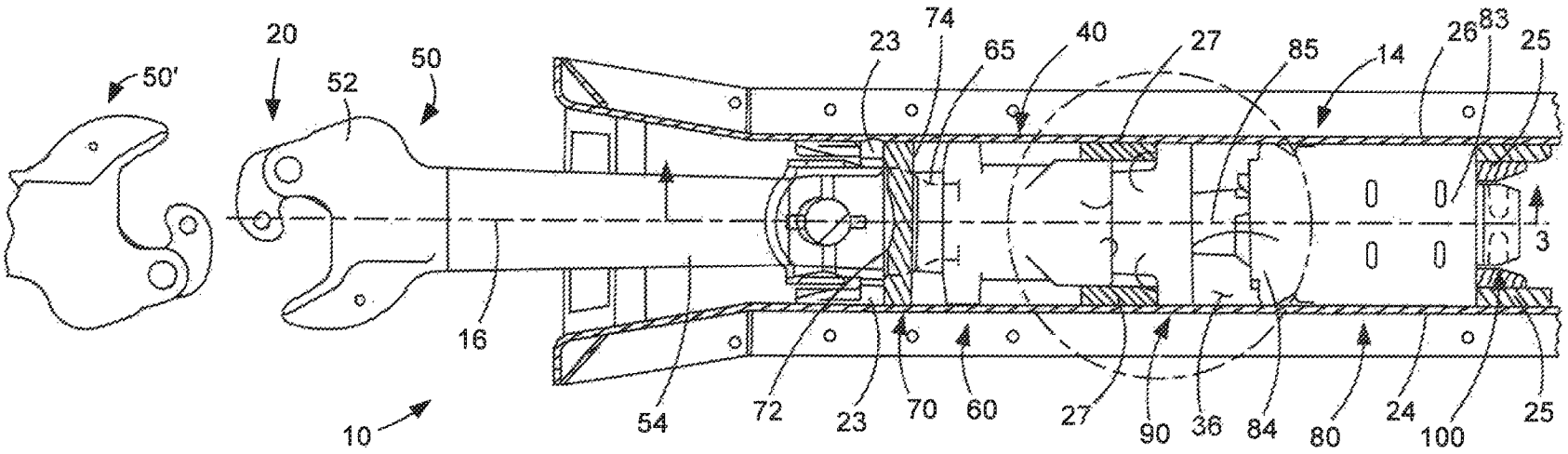
FIG. 2 is an enlarged fragmentary longitudinal sectional view of a portion of one embodiment of a rail car energy absorption system shown in a neutral condition or position and embodying principals and teachings of the present invention disclosure.

Referring now to the drawings, wherein like reference numerals indicate like parts throughout the several views, there is shown in FIG. 1 a railroad car, generally indicated by reference numeral 10. Although a railroad freight car is illustrated for exemplary purposes, it will be appreciated that the teachings and principals of this invention disclosure relate to a wide variety of railcars including, but not limited to, railroad freight cars, tank cars, railroad hopper cars, and etc. Suffice it to say, railcar 10 has a railcar body 12, in whatever form, supported on an axially elongated draft sill or centersill 14 defining a longitudinal axis 16 (FIG. 2). In the illustrated embodiment, the centersill 14 is designed as a throughsill and extends the length of the railcar 10. It should be appreciated, however, by those skilled in the art, the centersill 14 could take the form of a stub sill disposed toward opposite ends of car 10 without detracting or departing from the broad spirit and scope of this invention disclosure.

As shown in FIG. 1, a coupling system, generally identified by reference numeral 20, is provided toward opposite ends of the railcar 10 so as to allow adjacent railcars to be coupled to each other. In a preferred embodiment, each coupling system 20 provided toward opposite ends of car 10 are substantially identical relative to each other and, thus, both are identified by reference numeral 20.

The draft sill or centersill 14 shown by way of example in FIG. 2 can be cast or fabricated and has standard features. In the embodiment illustrated in FIG. 2, and toward each end thereof, the centersill 14 has a first or front pair of laterally spaced stops 23 and a pair of second or rear pair of laterally spaced stops 25 connected to laterally spaced walls 24 and 26 of the centersill 14 (FIG. 2). The front and rear pairs of stops 23 and 25, respectively, are longitudinally spaced apart from each other by a longitudinal distance suitable for accommodating a conventional and well known hydraulically operated cushioning assembly therebetween. In a preferred embodiment, the front and rear pairs of stops 23 and 25, respectively, extends the full height of the draft sill or centersill 14. In the illustrated embodiment, and as is required when a hydraulically operated cushioning assembly is used to absorb energy incurred during in-service operations, a pair of vertically disposed center stops 27 are arranged in operable combination with the centersill 14. Typically, the center stops 27 are arranged on and in combination with the centersill 14 proximately midlength between the front and rear pairs of stops 23 and 25, respectively.

Figure 3:
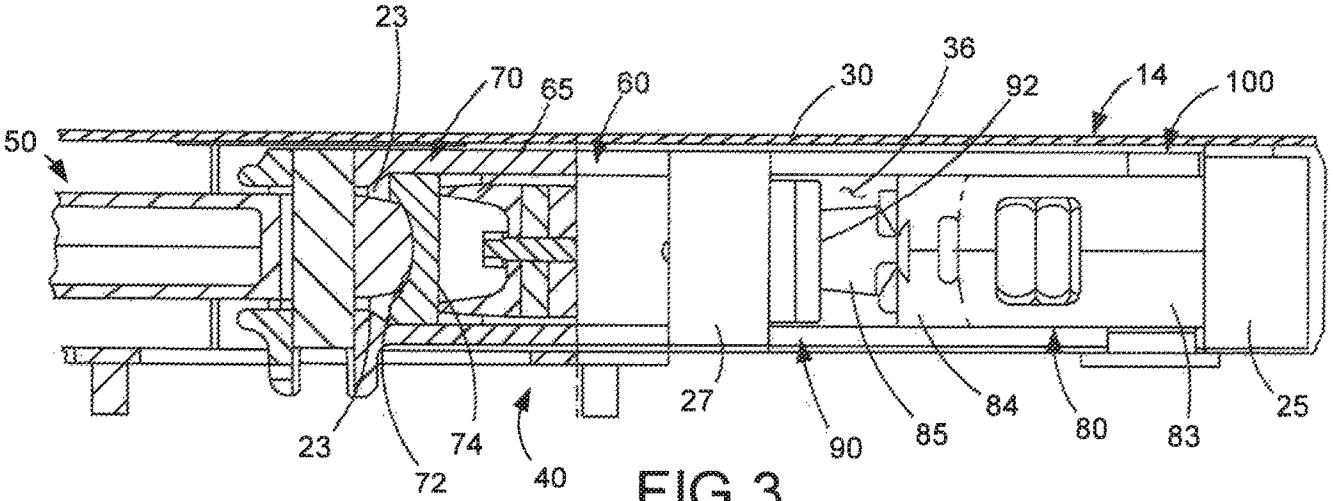
FIG. 3 is a partial sectional view taken along line 3-3 of FIG. 2.

In the embodiment illustrated by way of example in FIG. 3, the centersill 14 typically has a top wall 30, although it will be appreciated the present invention disclosure is equally applicable to and can be used with a draft sill or centersill lacking such a top wall. Known centersills also include the laterally spaced depending side walls 24 and 26 (FIG. 2). As is known, the pairs of stops 23, 25 and 27 are all secured to interior surfaces of the side walls 24 and 26 of the centersill 14. The centersill 14 can include other standard features and can be made of standard materials in standard ways. Returning to FIG. 2, the front and rear pairs of stops 23 and 25, respectively, combine to define a longitudinally elongated pocket 36 therebetween. The energy absorption system of this invention disclosure, generally indicated by reference numeral 40, can advantageously be used in operable combination with a variety of different draft sills or centersills 14.

The energy absorption system 40 is arranged in longitudinally disposed and operable combination with a standard coupler 50. The standard coupler 50 includes a head portion 52 and shank portion 54, preferably formed as a one-piece casting. As is typical, the coupler head portion 52 extends longitudinally outward from the centersill 14 to engage a similar coupler 50' extending from an end of a second and adjacent railcar (not shown) to be releasably coupled or otherwise connected to car 10 (FIG. 1). In operation, the shank portion 54 is guided for generally longitudinal movements by the centersill 14 of the railcar 10.

The energy absorption system 40 of the present invention disclosure includes first and second cushioning assemblies 60 and 80, respectively, arranged in generally axially aligned relation relative to each other and disposed in longitudinal and operable combination relative to each other. In a preferred embodiment of this invention disclosure, the first cushioning assembly 60 is designed and configured to significantly reduce buff forces directed against it. In the one embodiment of the energy management system 40, the second cushioning assembly 80 has greater energy absorption capability than does the first cushioning assembly 60. As described below, the tandem cushioning assembly arrangement of this invention disclosure permits the first and second cushioning assemblies 60 and 80 to operate in series relative to each other in response to buff loads being imparted to system 40. Advantageously, however, the tandem cushioning assembly arrangement of the present invention is configured to allow cushioning assembly 80 to operably act to cushion and absorb the draft loads being imparted to system 40 during operation of the railcar 10 while substantially limiting run-out travel and minimizing cycles from draft events during operation of the railcar 10 (FIG. 1).

The cushioning assembly 60 of each energy management system 40 is preferably positioned toward a forward end of the pocket 36 between the pair of forward stops 23 and the pair of center stops 27. The cushioning assembly 60 of each energy management system 40 initially receives and dissipates external buff forces experienced by the coupler 50; with such forces being transferred from the coupler head portion 52 to the butt end 54 of the coupler 50 during make-up of a train consist and in-service operations of such a train consist. As will be appreciated by those skilled in the art, the cushioning assembly 60 can take on any of a myriad of different designs and different operating characteristics without seriously departing or detracting from the true spirit and novel concept of this invention disclosure. In one form, the cushioning assembly 60 illustrated in the drawings can include a draft gear assembly of the type manufactured and sold by Miner Enterprises, Inc. under Model No, TP-17.

Figure 4:
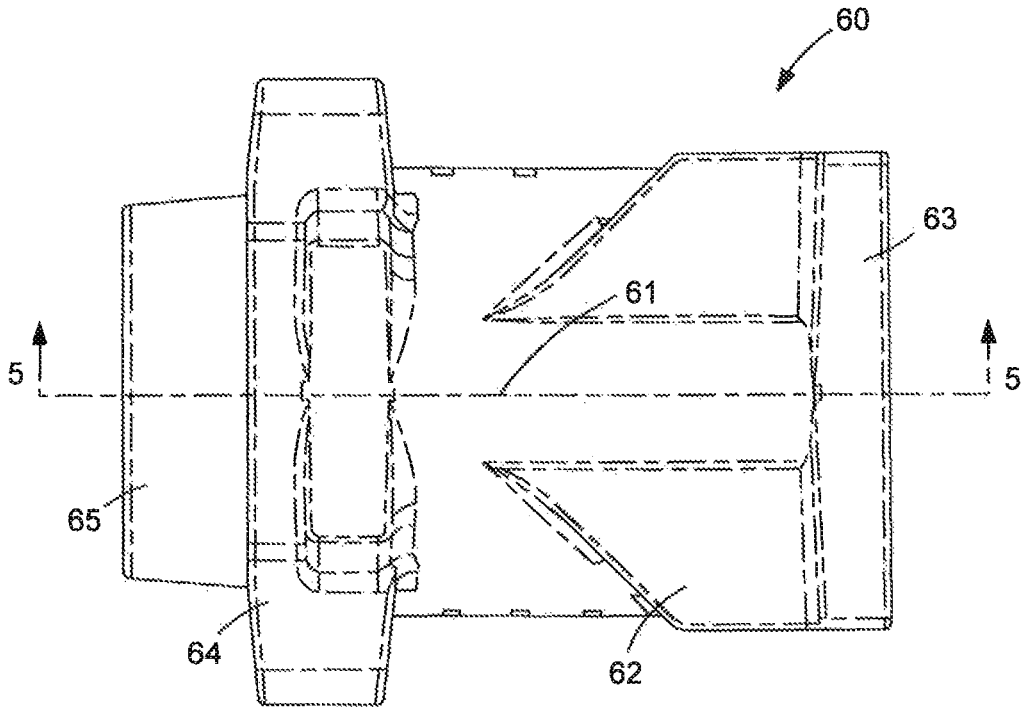
FIG. 4 is a top plan view of one form of a first cushioning assembly forming part of the rail car energy absorption system of the present invention disclosure.
Figure 5:
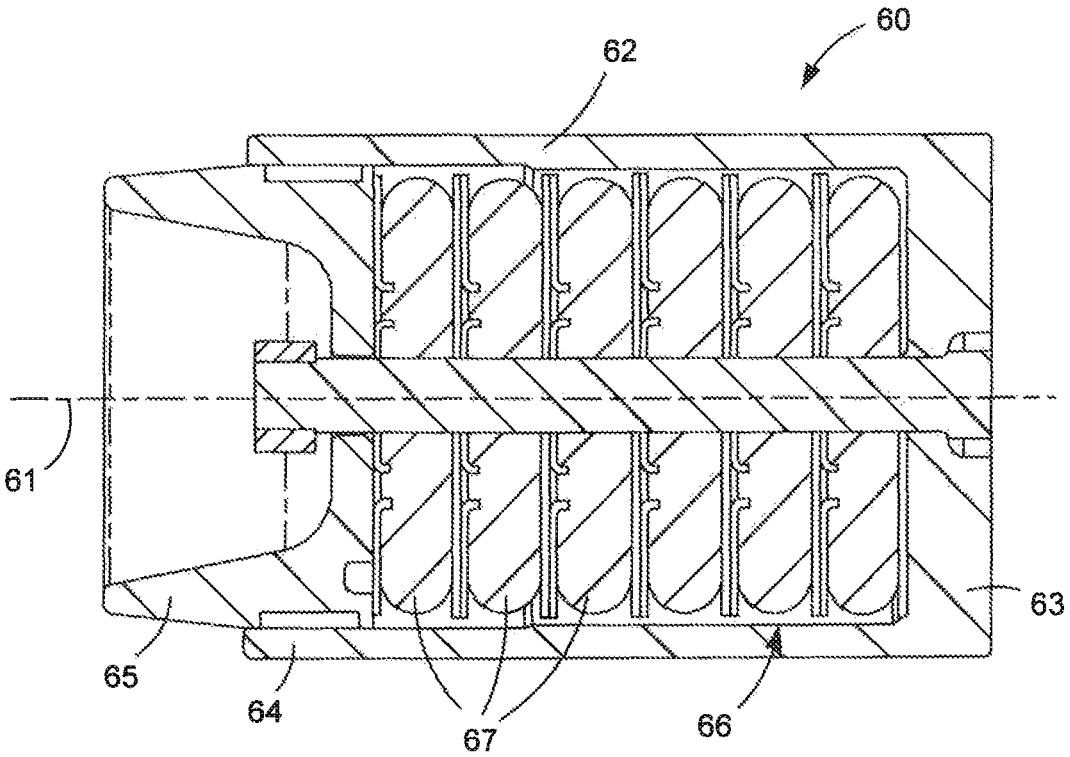
FIG. 5 is a sectional view taken along line 5-5 of FIG. 4.

In the form illustrated by way of example in FIGS. 4 and 5, the first cushioning assembly 60 defines a longitudinal axis 61 arranged in generally longitudinal alignment with the longitudinal axis 16 of car 10 (FIG. 2). Preferably, the first cushioning assembly 60 includes a hollow metal housing 62 having a closed first or rear end 63 and an open second or forward end 64. A plunger 65 is arranged for reciprocal sliding movements within the open second or forward end 64 of the housing 62. Notably, the first cushioning assembly 60 is designed and configured to inhibit the plunger 65 from inadvertently separating from the housing 62 during operation of the first cushioning assembly 60. Also, and as shown in FIG. 5, the first cushioning assembly 60 includes a resilient spring 66 for consistently urging the plunger 65 toward an extended position (FIGS. 2 and 3) when the first cushioning assembly is in a neutral position. Spring 66 serves to absorb, dissipate and return energy imparted to the first cushioning assembly 60 during operation of the energy absorption system 40 of the present invention disclosure. In the embodiment illustrated by way of example in FIG. 5, spring 66 of the first cushioning assembly 60 includes a series of axially stacked elastomeric pads 67 arranged between the rear end 63 of housing 62 and plunger 65 of assembly 60.

Figure 8:
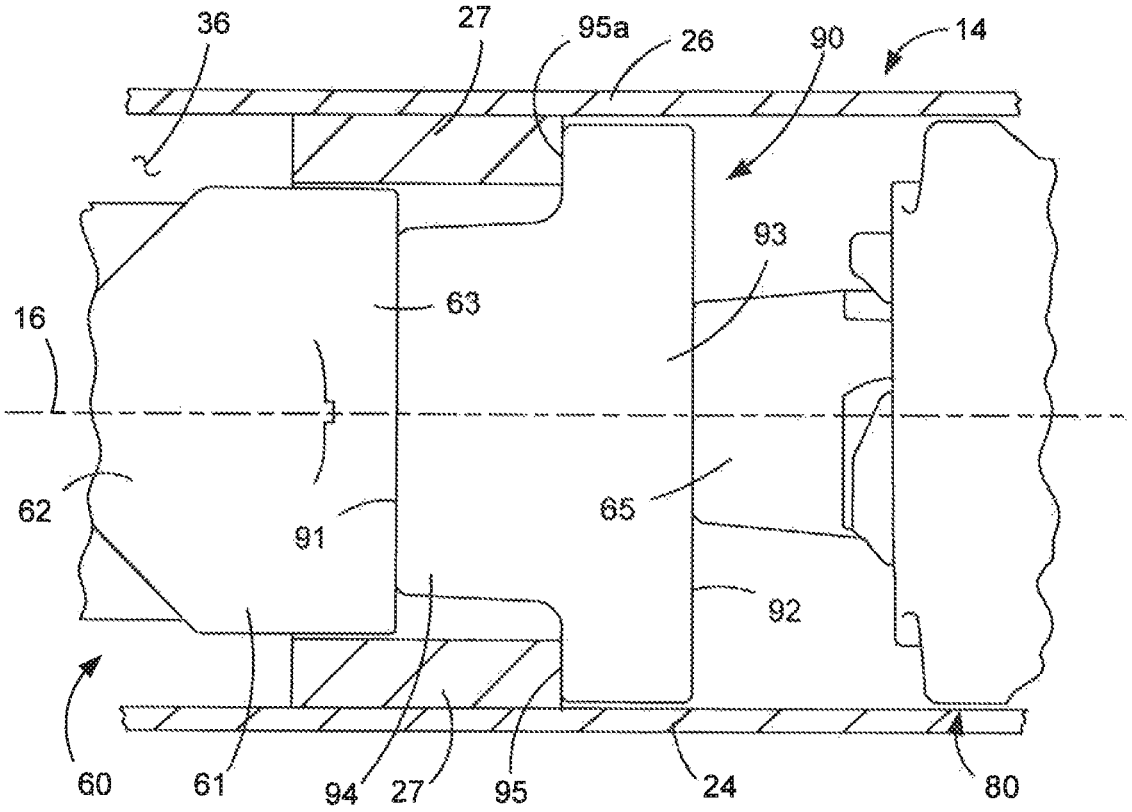
FIG. 8 is a fragmentary view of that area encircled in phantom lines in FIG. 2.

Notably, as best shown in FIG. 8, although useful in combination with a well-known hydraulically operated cushioning assembly (not shown), the laterally spaced pair of center stops 27 on sill 14 significantly reduce the envelope or lateral open space on the sill 14 especially in that area of the pocket 36 between the upstanding stops 27 on the centersill 14 and wherein a rear end 63 of the housing 62 of the first cushioning assembly 60 is accommodated.

Although available as an option, removing the center stops 27 from sill 14 to increase the size of such envelope or lateral space in the pocket 36 is cost prohibitive. That is, such option requires railcar 10 to be out of service for an extended time period while the pair of center stops 27 are removed. Also, removal of the pair of center stops 27 furthermore materially weakens the centersill 14. As such, and in a preferred embodiment of the present invention disclosure, the pair of center stops 27 remain an integral part of the sill 14. Instead, the first or rear end 63 of the housing 62 of the first cushioning assembly 60 is configured to be positioned in the narrowed space between the pair of upstanding center stops 27 on the centersill 14.

Figure 9:
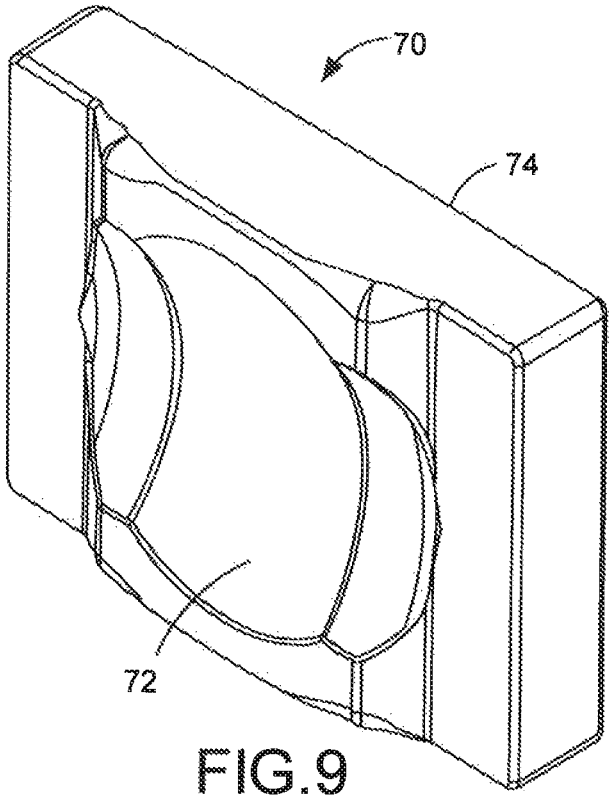
FIG. 9 is a top perspective view of one form of first follower forming part of the rail car energy absorption system of the present invention disclosure.

Returning to that embodiment illustrated by way of example in FIGS. 2 and 3, the energy absorption system 40 of the present invention disclosure further includes a first follower 70 positioned in the pocket 36. As illustrated in FIG. 9, the follower 70 is of a conventional design and includes a front face 72 and a rear face 74. Returning to FIGS. 2 and 3, the front face 72 of follower 70 is configured to engage, impact and operate in combination with a terminal end of the shank portion 54 of coupler 50. The rear face 74 of follower 70 is engaged by the terminal end of the plunger 65 of the first cushioning assembly 60. When assembled in combination with and the first cushioning assembly 60 is in a "neutral" position, the free end of plunger 65 urges the follower 70 toward the left as shown in FIGS. 2 and 3 and into engagement with the front pair of stops 23 on sill 14.

As illustrated by way of example in FIGS. 2 and 3, cushioning assembly 80 is positioned in the pocket 36 in operable combination with and longitudinally rearward of the first cushioning assembly 60 and longitudinally extends substantially between the pair of center stops 27 and the pair of rear stops 25. The cushioning assembly 80 of each energy management system 40 acts in series with the first cushioning assembly 60 to receive and dissipate forces exerted thereagainst by the first cushioning assembly 60. As will be appreciated by those skilled in the art, the cushioning assembly 80 can take on any of a myriad of different designs and different operating characteristics without departing or detracting from the true spirit and novel concept of this invention disclosure. For example, the cushioning assembly 80 illustrated in the drawings can include a draft gear assembly of the type manufactured and sold by Miner Enterprises, Inc. under Model No. TF-2475. In a preferred embodiment, the second cushioning assembly 80 has a combined axial travel of about 9.5 inches in both buff and draft directions.

Figure 6:
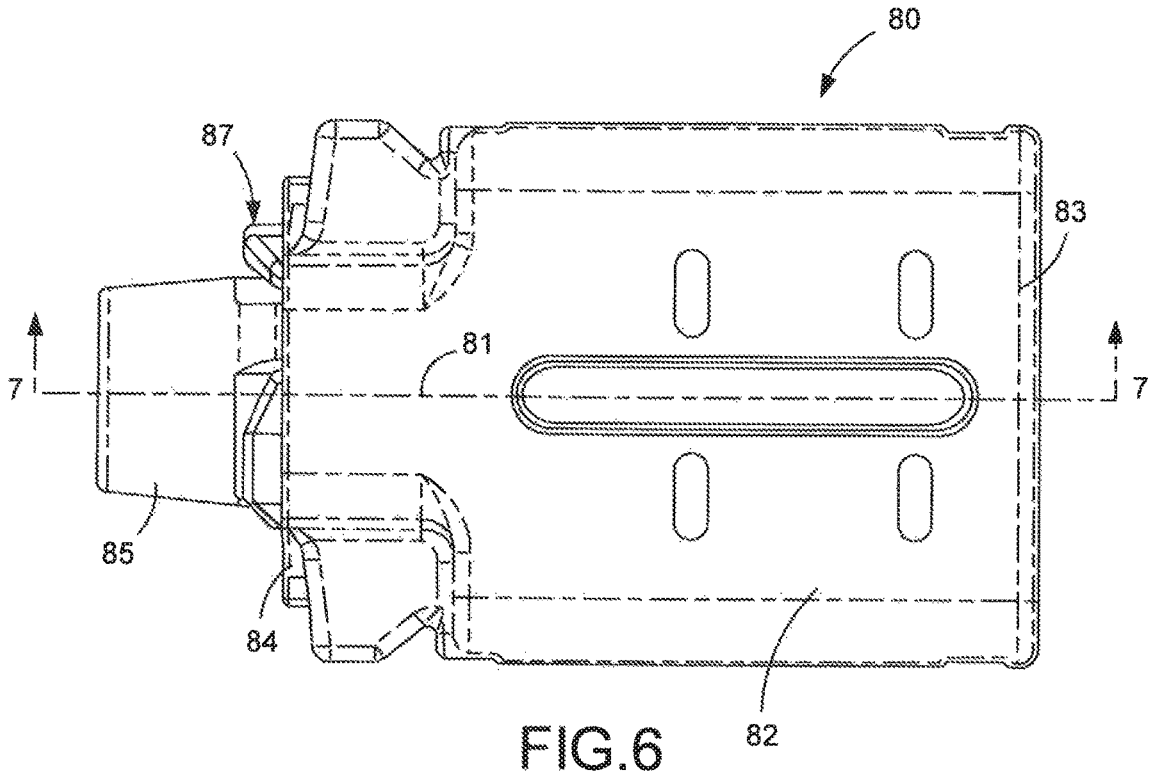
FIG. 6 is a is a top plan view of one form of a second cushioning assembly forming part of the rail car energy absorption system of the present invention disclosure.
Figure 7:
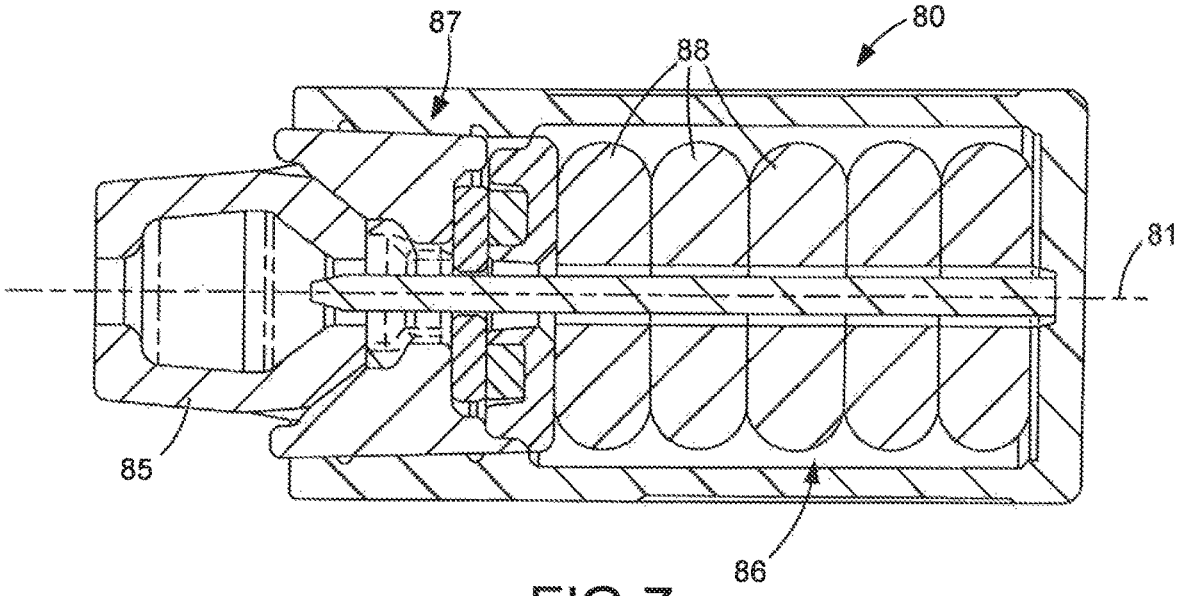
FIG. 7 is a sectional view taken along line 7-7 of FIG. 6.

In the embodiment illustrated by way of example in FIGS. 6 and 7, the second cushioning assembly 80 of each energy management system 40 defines a longitudinal axis 81 arranged in generally longitudinal alignment with the longitudinal axis 16 of car 10 (FIG. 2) and the longitudinal axis 61 of cushioning assembly 60 when the first and second cushioning assemblies 60 and 80, respectively, are arranged in operable combination relative to each other. Preferably, cushioning assembly 80 includes a hollow metal housing 82 having a closed first or rear end 83 and an open second or forward end 84. A wedge 85 is preferably arranged for reciprocal endwise sliding movements within the open second or forward end 84 of the housing 82. Notably, cushioning assembly 80 is designed and configured to inhibit the wedge 85 from inadvertently separating from the housing 82 during operation of the second cushioning assembly 80. As illustrated in FIG. 7, the second cushioning assembly 80 includes a resilient spring 86 acting in concert with a conventional friction clutch assembly 87 for absorbing, dissipating and returning energy imparted to the second cushioning assembly 80 during operation of the energy absorption system 40 of the present invention disclosure. Preferably, spring 86 includes an axial stack of elastomeric pads 88 disposed between the rear end 83 of housing 82 and the clutch assembly 87. In operation, spring 86 serves to resiliently urge the wedge 85 toward an extended position relative to housing 82.

In a preferred embodiment illustrated by way of example in FIGS. 2 and 3, the energy absorption system 40 of the present invention disclosure also includes a second follower 90. Follower 90 is arranged in operable combination with the first and second cushioning assemblies 60 and 80, respectively.

Figure 10:
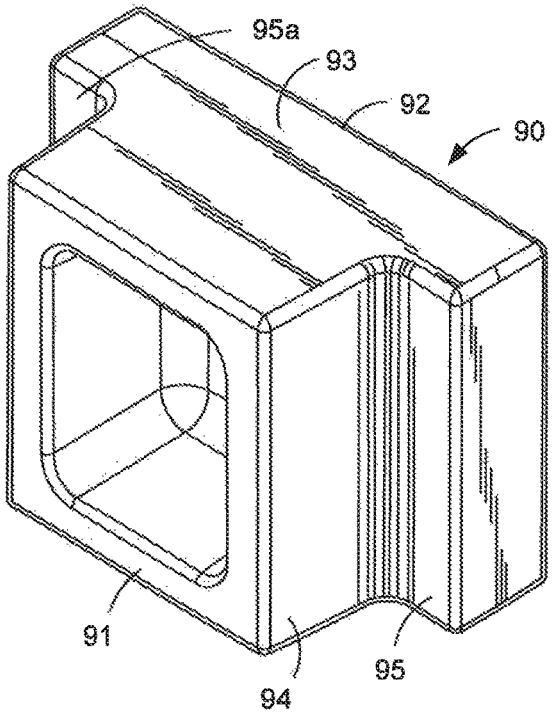
FIG. 10 is a top perspective view of one form of a second follower forming part of the rail car energy absorption system of the present invention disclosure.
Figure 11:
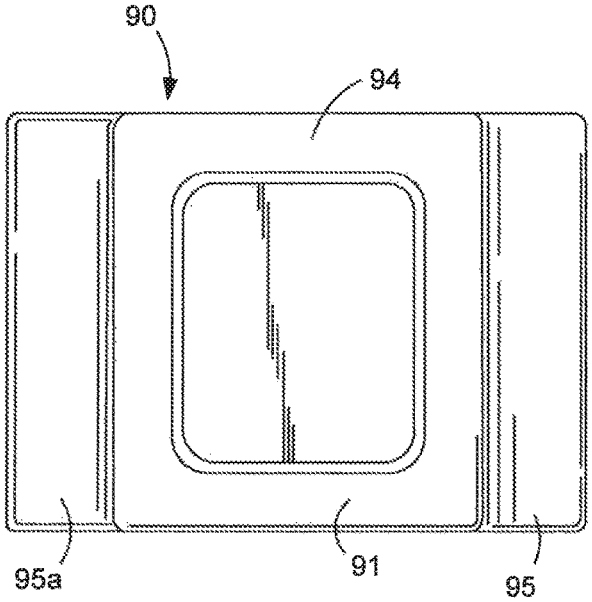
FIGS. 11, 12 and 13 are various views of the second follower illustrated in FIG. 10.
Figure 12:
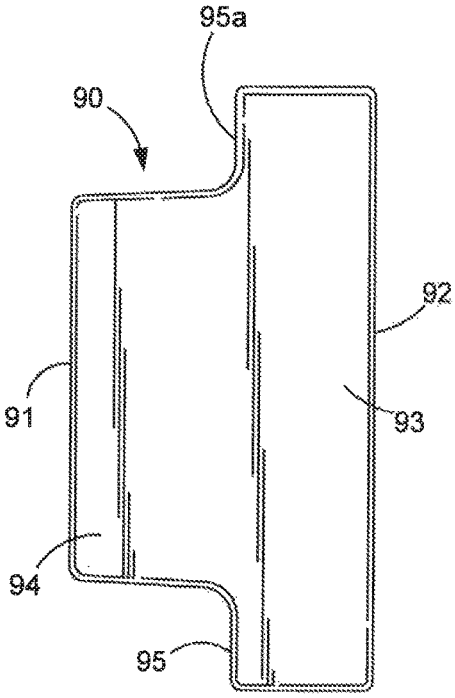
Figure 13:
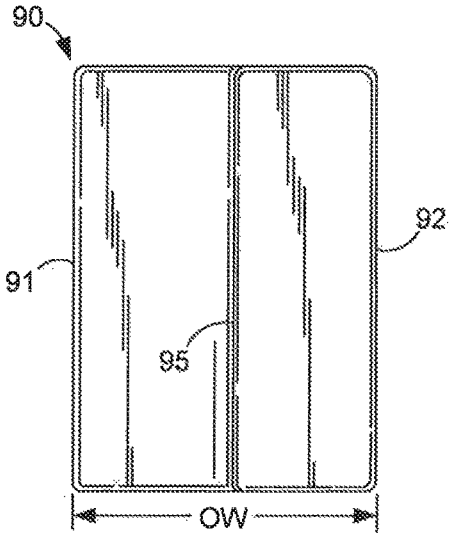

In the embodiment illustrated by way of example in FIGS. 10 and 12, the second follower 90 has a generally T-shaped configuration when viewed from a top thereof. As shown by way of example in FIGS. 10, 12 and 13, follower 90 has a front face 91 and a rear face 92 extending generally parallel to each other. It should be understood and appreciated, the overall width (OW) between the front face of 91 and rear face 92 of the second follower 90 (FIG. 13) can vary from that schematically illustrated to allow the principals and teachings of the present invention disclosure to be used in various rail cars having pockets of different sizes between the front stops 23 and rear stops 25 (FIG. 2).

Figure 16:
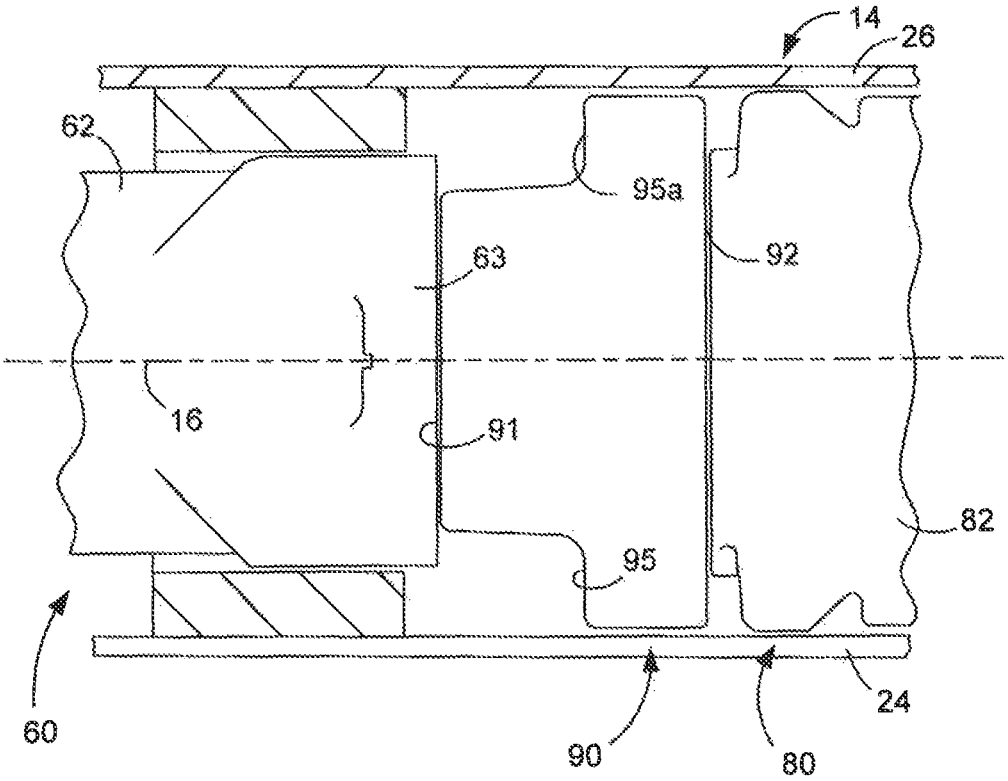
FIG. 16 is an enlarged fragmentary view of that area encircled in phantom lines in FIG. 14.
Figure 19:
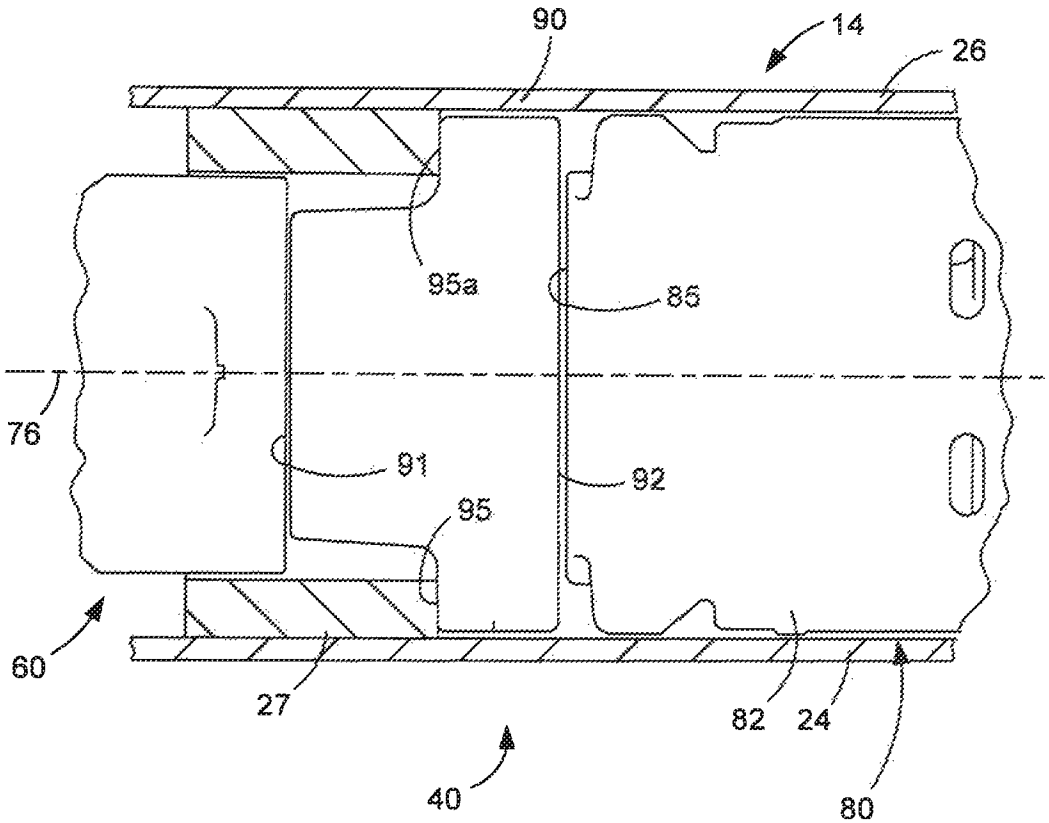
FIG. 19 is an enlarged fragmentary view of that area encircled in phantom lines in FIG. 17.

In the embodiment illustrated by way of example in FIGS. 10 and 12, follower 90 has an enlarged rear section 93 and a smaller front section 94 preferably formed integral with and extending forward from the rear section 93. The difference in sizes between the rear section 93 and front section 94 provides follower 90 with two limit stops or shoulders 95 and 95*a* each of which extends in a common plane relative to each other and generally parallel to the rear face 92 of follower 90. Suffice it to say, and as shown in FIGS. 16 and 19, the follower 90 is configured such that the front section 94 thereof is configured to slide and fit between the pair of center stops 27 on sill 14 while the limit stops 95 and 95*a* limit the rear section 93 of follower 90 from moving past the pair of center stops 27 and toward the first cushioning assembly 60 during operation of the energy absorption system 40.

In the illustrated embodiment, the front section 94 of follower 90 is configured to advantageously and slidably extend between the pair of center stops 27 on sill 14 whereby allowing the front face 91 of follower 90 to engage, impact and operate in combination with the rear end 63 of the first cushioning assembly housing 62 during operation of the energy absorption system 40. The rear face 92 of follower 90 is engaged by the distal or free end of the wedge 85 of the second cushioning assembly 80. When assembled in combination with and the second cushioning assembly 80 is in a "neutral" position (FIG. 8), the free end of wedge 85 of the second cushioning assembly 80 urges follower 90 to the left as shown in FIG. 8 until the limit stops 95 and 95*a* on follower 90 under the influence of the second conditioning assembly 80 engage with the center pair of stops 27 on sill 14.

Returning to FIGS. 2 and 3, the energy absorption system 40 of this invention disclosure further includes an axially elongated yoke 100 which, in one form, comprises a steel casting or it can be fabricated from separate steel components. A forward end of yoke 100 is coupled to shank portion 54 of the coupler 50. In the embodiment illustrated by way of example in FIG. 2, yoke 100 is configured for use with a standard F type coupler but it will be readily appreciated with slight redesign efforts known to those skilled in the art, the principals and teachings of this invention disclosure equally apply to a yoke configured for use with a standard F type coupler without detracting or departing from the novel spirit and broad scope of this invention disclosure.

Figure 14:
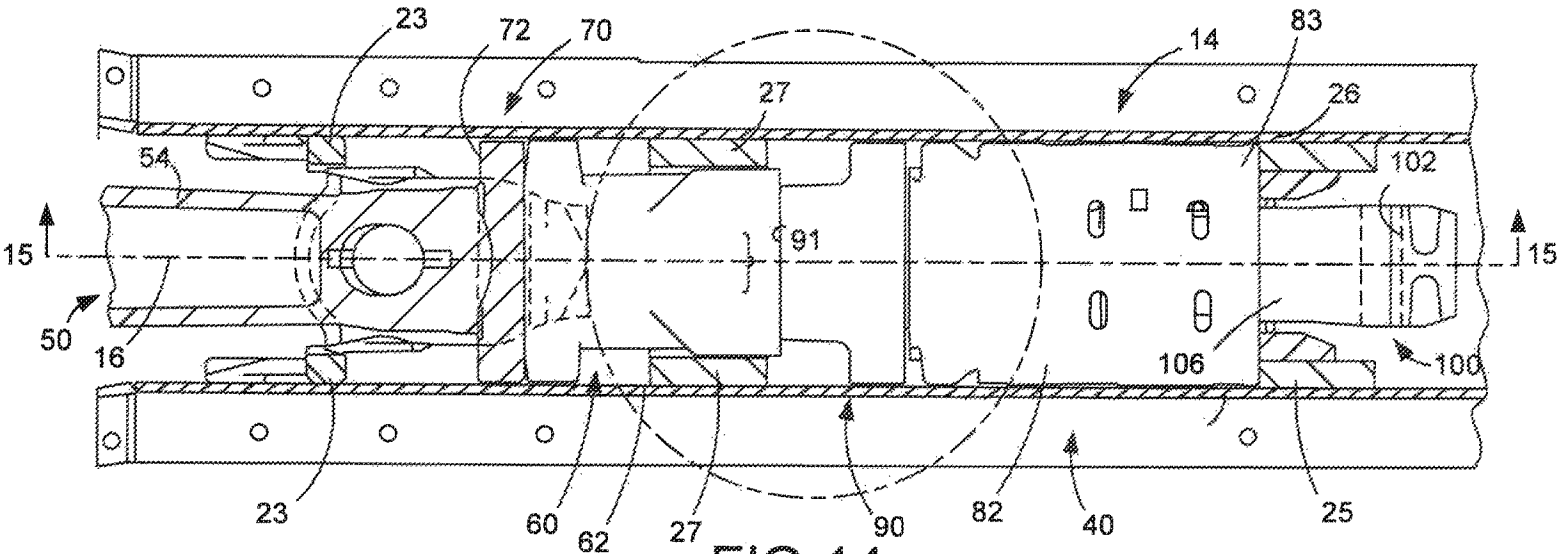
FIG. 14 is an enlarged fragmentary longitudinal sectional view similar to FIG. 2 but showing the rail car energy absorption system in a full buff condition or position.
Figure 15:
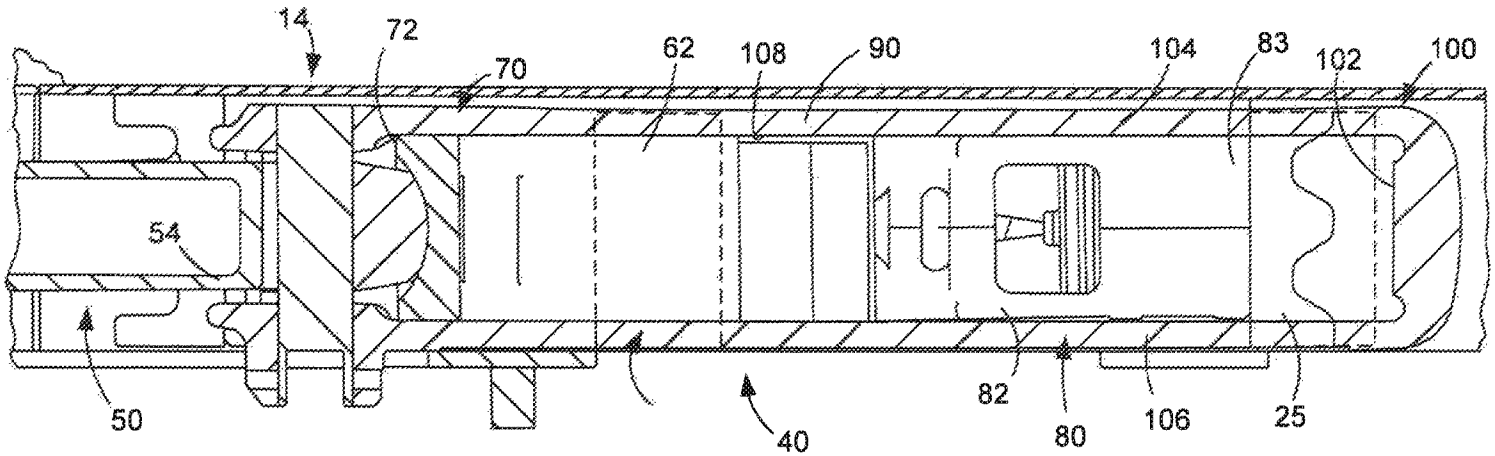
FIG. 15 is a is a partial sectional view taken along line 15-15 of FIG. 14.

Turning to the embodiment illustrated by way of example in FIGS. 14 and 15, yoke 100 has a sideways inverted generally U-shape configuration, in the illustrated embodiment, yoke 100 preferably includes a back wall 102, a top wall 104 and a bottom wall 106. In a preferred form, the top and bottom walls 104 and 106, respectively, are rigidly joined to and extend forward from the back wall 102 and terminate toward a forward open end. As is typical, the top and bottom walls 104 and 106, respectively of yoke 100 extend generally parallel to each other to define a linearly unobstructed chamber 108 (FIG. 15) which readily accommodates and encompasses the first and second cushioning assemblies 60 and 80 of the energy absorbing apparatus 40 therebetween. While embracing the first and second cushioning assemblies 60 and 80, respectively, of the energy absorbing apparatus 40 therebetween, the top and bottom walls 104 and 106, respectively, of yoke 100 are designed and configured to allow for endwise sliding movements relative to the housings 62 and 82 of the first and second cushioning assemblies 60 and 80, respectively. Moreover, the top and bottom walls 104 and 106, respectively, of yoke 100 are designed with sufficient length to accommodate added components of the energy absorbing apparatus 40 between the bad wall 102 and the location whereat yoke 100 is operably connected to the shank portion 54 of coupler 50. Moreover, the yoke 100, when used in with the illustrated tandem cushioning assembly arrangement, is configured to allow installation and removal of the component parts of the energy absorbing apparatus 40 relative to the sill 14 using standard and well known installation procedures and into operable combination with coupler 50.

As mentioned, FIGS. 2 and 3 schematically illustrate the energy management system 40 of the present invention disclosure in a substantially neutral position or condition. As such, the rear 83 of housing 82 of the second cushioning assembly 80 engages with the rear pair of stops 25 on the centersill 14 and the wedge or plunger 85 of the second cushioning assembly 80 axially extends beyond the open end 84 of second cushioning assembly housing 82 into engagement with the rear face 92 of the second follower 90. The stops 95, 95*a* on the second follower 90 limit the extent follower 90 can move relative to the pair of center stops 27. The front face 91 of the follower 90 engages the rear face or end 63 and pushes or urges the first cushioning assembly 60 to the left as shown in FIGS. 2 and 3.

As shown in FIG. 5, when the energy management system 40 of the present invention disclosure is in a substantially neutral position, the plunger 65 of the first cushioning assembly 60 axially extends, under the influence of spring 66 of the first cushioning assembly 60, from the open end 64 of first cushioning assembly housing 62 and is biased into engagement with the rear face 74 of the first follower 70. As such, and when the energy management system 40 of the present invention disclosure is in a substantially neutral position as she shown in FIGS. 2 and 3, the first follower 70 is urged into biased engagement with the front pair of stops 23 on sill 14.

FIGS. 14 and 15 schematically illustrate the energy management system 40 of the present invention disclosure in a full "buff" position or condition. That is, when a buff force is directed by the coupler 50 against the energy absorption system 40 of the present invention disclosure, the shank portion 54 of the coupler 50 moves to the right as illustrated in FIGS. 14 and 15 from the position schematically illustrated in FIGS. 2 and 3. Accordingly, the free end of the Shank portion 54 of coupler 50 pushes against the front face 72 of follower 70 whereby moving follower 70 away from the stops 23 (FIG. 14). Also, movement of the follower 70 in a buff direction and away from the stops 23 causes the plunger 65 (FIGS. 2, 3 and 5) of the first cushioning assembly 60 to axially retract within the housing 62 and against the resilient action of the spring 65 of the first cushioning assembly 60 so as to offer a first level of resistance or force to the plunger 65 of the first cushioning assembly 60 retracting within the housing 62 of the first cushioning assembly 60.

Notably, as schematically illustrated in FIG. 16, in response to a sufficient buff force being directed thereagainst, the first cushioning assembly 60, the rear end 63 of housing 62 moves past the pair of center stops 27 and pushes against the front face 91 of the second follower 90. In this regard, these Applicants were the first to appreciate how redesigning and reconfiguring the first cushioning assembly housing 62 would permit the first cushioning assembly housing 62 to move within the limited space constraints defined between the center pair of stops 27 on centersill 14. As such, the time and expense which would normally be incurred in connection with having to remove the center pair of stops 27 from sill 14 to accomplish that achieved for the first time by the present invention are eliminated.

As will be appreciated from an understanding of this invention disclosure, cushioning assembly 80 acts in series or concert with the first cushioning assembly to absorb, dissipate and return energy imparted to the system 40 during buff operations of railcar 10 (FIG. 1). As mentioned, and in response to a sufficient buff force being directed thereagainst, cushioning assembly housing 62 moves past the pair of center stops 27 and pushes against the front face 91 of the second follower 90. In turn, and because the rear end 83 (FIGS. 14 and 15) of the second cushioning assembly 80 engages the pair of rear stops 25 on sill 14, buff movement of follower 90 pushes against and causes the wedge or plunger 85 (FIGS. 2, 3, 6 and 7) of the second cushioning assembly 80 to axially retract within the housing 82. As wedge 85 moves axially inward of the second cushioning assembly housing 82 it acts against both the resilient action of the spring 86 and the clutch assembly 87 of the second cushioning assembly 80 which combine to offer a second level of resistance or force to the plunger 85 of the second cushioning assembly 80 axially retracting within the housing 82 of cushioning assembly 80.

Notably, when a buff impact of force is directed against the energy absorption system 40 of the present invention disclosure, yoke 100 also slides relative to the first and second cushioning assemblies 60 and 80, respectively, and to the right as seen in FIGS. 14 and 15. After the buff force applied to the coupler 50 collapses the plungers 65 and 85 of the first and second cushioning assemblies 60 and 80, respectively, as discussed above, yoke 100 moves into a full huff position or condition wherein the back wall 102 of the yoke 100 is longitudinally spaced from the first or rear end 83 of the second cushioning assembly 80.

Figure 17:
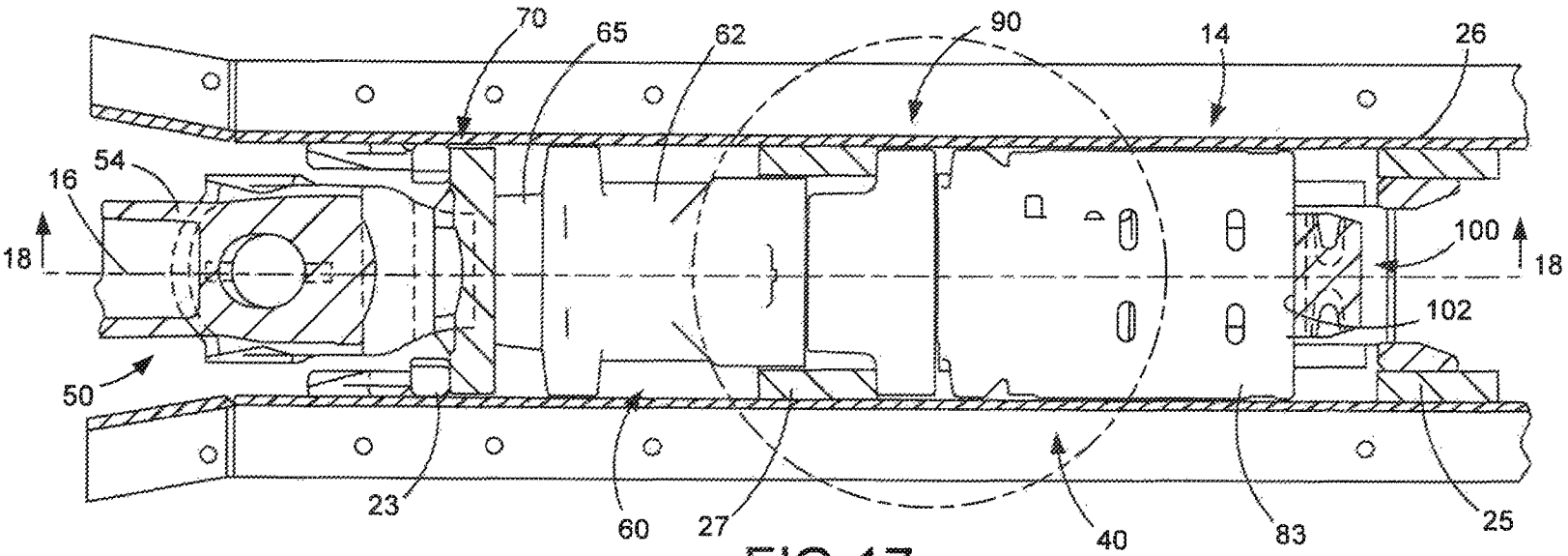
FIG. 17 is an enlarged fragmentary longitudinal sectional view similar to FIG. 2 but showing the rail car energy absorption system in a full draft condition or position.
Figure 18:
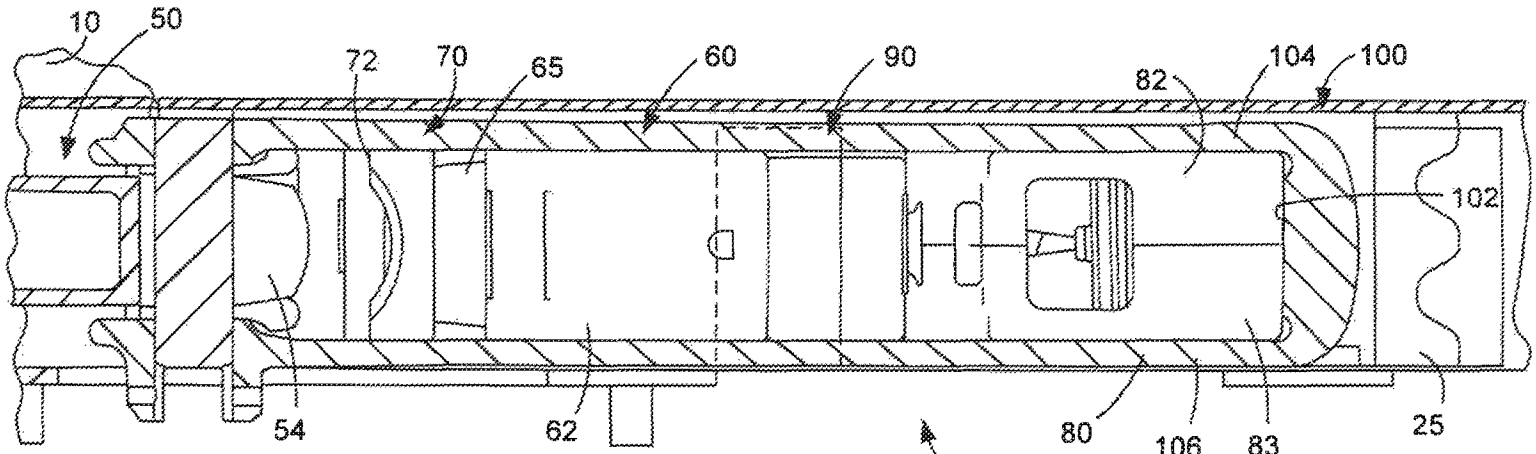
FIG. 18 is a is a partial sectional view taken along line 18-18 of FIG. 17.

FIGS. 17 and 18 schematically illustrate the energy management system 40 of the present invention disclosure in a full "draft" position or condition. That is, when a draft force is directed by the coupler 50 against the energy absorption system 40 of the present invention disclosure, the shank portion 54 of coupler 50 along with the yoke 100 move to the left as illustrated in FIGS. 17 and 18. As such, the back wall 102 of yoke 100 engages with and pushes the first or rear end 83 of the second cushioning assembly 80 to the left while the stops 95, 95*a* of the second follower 90 abut against the center stops 27 on sill 14 to hold the follower 90 in place as illustrated in FIGS. 17 and 18. As illustrated in FIG. 19, movement of the second cushioning assembly 80 continues in a draft direction until wedge 85 completely retracts into the housing 82 and the second cushioning assembly 80 is completely closed and prevented from further movement in the draft direction by the second follower 90. As will be appreciated from an understanding of this invention disclosure, in a draft direction, the second follower 90 acts in concert with the pair of center stops 27 on sill 14 and the second cushioning assembly 80 to lessen axial movements of the components of the energy absorption system, 40 and connected railcars relative to each other. With the present invention disclosure, the useful duration and overall operability of the energy absorption system 40 is advantageously prolonged.

Moreover, there is disclosed a method for absorbing energy on a railcar 10 having an axially elongated centersill 14 with a pair of front stops 23 and a pair of rear stops 25 defining an elongated pocket 36 therebetween. Centersill 14 also has a pair of center stops 27 disposed proximately midway between the front stops 23 and the rear stops 25. Railcar 10 also has a coupler 50 with a head portion 52 and a shank portion 54. The coupler head portion 52 axially extends beyond an end of the centersill 14 for allowing adjacent railcars to be interconnected to each other.

The method comprises the steps of: positioning a first cushioning assembly 60 in the centersill pocket 36 between the front stops 23 and the center stops 27. The first cushioning assembly 60 includes a housing 62, a plunger 64 arranged for axial sliding movements within an open end of the housing 62, and a resilient spring 66 for consistently urging the plunger 64 toward an extended position relative to the first cushioning assembly housing 62.

Another step in the method comprises: arranging a first follower 70 such that the first follower 70 is urged toward and engageable with the front stops 23 under the influence of the first cushioning assembly 60. The first follower 70 is operably engageable with a free-end of the coupler shank portion 54.

According to this aspect of the invention disclosure, another step in the method comprises: arranging a second cushioning assembly 80 in the centersill pocket 36 between the center stops 27 and the rear stops 25. The second cushioning assembly 80 includes a housing 82, a plunger 85 arranged for axial sliding movements within an open end of the second cushioning assembly housing 82, and a resilient spring 86 for consistently urging the second cushioning assembly plunger 85 toward an extended position relative to the second cushioning assembly housing 82. The method also comprises the step of: arranging a second follower 90 in the centersill pocket 36 such that the second follower 90 is urged toward and is configured to engage with the center stops 27 under the influence of the second cushioning assembly.

The method further includes the step of: arranging an axially elongated yoke 100 having a back wall 102 along with top and bottom walls 104 and 106, respectively, which extend forwardly from the back wall 102 such that the top and bottom walls 104 and 106, respectively, of the yoke 100 entrap the first and second cushioning assemblies 60 and 80, respectively, therebetween and terminate in an open forward end and is coupled to and moves with the coupler shank portion 54. The back wall 102 of the yoke 100 engages with a rear end 83 of the second cushioning assembly 80 when the coupler 50 is pulled in draft.

According to this aspect of the invention disclosure, the first and second cushioning assemblies 60 and 80, respectively, act in series relative to each other to absorb and cushion energy directed against them when the energy absorption system 40 operates in a buff direction. Notably, with the present invention disclosure, only the second cushioning assembly 80 of each energy absorption system 40 operates in a draft direction. That is, the second follower 90 acts in concert with the pair of center stops 27 and the second cushioning assembly 80 to enhance or minimize draft energy realized during in-service train operations and thereby better control train actions.

Preferably, the method for absorbing energy on the railcar 10 comprises the further step of: configuring the first cushioning assemblies 60 to significant reduce buff forces directed against it. In one form, the second cushioning assembly has greater energy absorption capabilities than does the first cushioning assembly. In a preferred embodiment, the method for absorbing energy on the railcar 10 further includes the step of: configuring the second follower 90 such that it has a generally T-shape when viewed from a top thereof. In one form, the method for absorbing energy on the railcar 10 can also include the step of: designing the second follower 90 such that a forward end of the second follower 90 engages an end of the first cushioning assembly housing 62 after the first and second cushioning assemblies 60 and 80, respectively are arranged in operative cooperation relative to each other.

In one embodiment, the method for absorbing energy on a railcar 10 can further include the step of: using various second followers 90 having varying thicknesses to accommodate railcars having different size pockets between the front and rear stops 23 and 25, respectively. The method for absorbing energy on a railcar 10 preferably includes the further step of: configuring each housing 62 of the first cushioning assembly 60 and the housing 82 of the second cushioning assembly 80 with a closed end and an open end. Preferably, the method for absorbing energy on a railcar further comprises the step of: allowing the yoke 100 to move relative to the housing of both the first cushioning assembly 60 and the second cushioning assembly 80.

As will be appreciated from an understanding of this invention disclosure, the capability of the energy absorption system 40 to absorb, dissipate and return energy is dependent on any number of different factors. In one system, and with no changes to the design of the centersill 14 on car 10 or the existing position or provision of the front stops 23, the rear stops or center stops 27, the dual draft gear design of system 40 of the present invention disclosure allows it to consistently and repeatedly withstand, in buff, between about 120,000 to about 150,000 ft. lbs of energy being imparted thereto while not exceeding a maximum force level of about 700,000 lbs while the system 40 incurs travel of about 7.5 inches. In such system, and with no changes to the design of the centersill 14 on car 10 or the existing position or provision of the front stops 23, the rear stops or center stops 27, the dual draft gear design of system 40 of the present invention disclosure allows it to consistently and repeatedly withstand, in draft, between about 80,000 to about 90,000 ft. lbs of energy being imparted thereto while not exceeding a maximum force level of about 700,000 lbs while the system 40 incurs travel of about 4.5 inches. Of course, and as will be appreciated, other systems having different designs while incorporating the teachings and principals of this invention disclosure can embody different operating characteristics without detracting or departing from the spirit and scope of this invention disclosure.

From the foregoing, it will be observed that numerous modifications and variations can be made and effected without departing or detracting from the true spirit and novel scope of this invention disclosure. Moreover, it will be appreciated, the present disclosure is intended to set forth exemplifications which are not intended to limit the disclosure to the specific embodiments illustrated and described. Rather, this disclosure is intended to cover by the appended claims all such modifications and variations as fall within the spirit and scope of the claims.

What is claimed is:

1. An energy absorption system on a railcar having an axially elongated centersill with a pair of front stops and a pair of rear stops defining an elongated pocket therebetween, with said centersill also having a pair of center stops disposed between said pair of front stops and said rear stops, a coupler having a head portion and a shank portion, with the head portion of said coupler axially extending beyond an end of the centersill, with said energy absorption system comprising:

a first cushioning assembly positioned in said pocket of said centersill between the pair of front stops and said pair of center stops, with said first cushioning assembly including a housing, a plunger arranged for axial sliding movements within an open end of said housing, and a resilient spring for consistently urging said plunger toward an extended position relative to said housing;

a first follower positioned in said pocket of said centersill and normally urged toward and engageable with said front pair of stops under the influence of the spring of said first cushioning assembly, with said first follower being operably engageable with a free end of the shank portion of said coupler;

a second cushioning assembly positioned in said pocket of said centersill between said pair of center stops and said pair of rear stops, with said second cushioning assembly including a housing, a wedge arranged for axial sliding movements within an open end of said housing, and a resilient spring for consistently urging the wedge of said second cushioning assembly toward an extended position relative to the housing of said second cushioning assembly;

a second follower positioned in said pocket and normally urged toward and configured to engage with said center pair of stops under the influence of the spring of said second cushioning assembly;

an axially elongated yoke having a back wall engageable with a rear end of said second cushioning assembly along with top and bottom walls which extend forwardly from said back wall so as to encompass said first and second cushioning assemblies therebetween and terminating in an open forward end, with the forward end of said yoke being coupled to the Shank portion of said coupler; and wherein said first and second cushioning assemblies act in series relative to each other to absorb and cushion energy directed against them when said energy absorption system operates in a buff direction, and with said second follower acting in concert with said pair of center stops and said second cushioning assembly to operatively isolate said first cushioning assembly from draft events to minimize excessive draft travel and better dissipate rebound energy.

2. The railcar energy absorption system according to claim 1, wherein said first and second cushioning assemblies differ in their energy absorption capabilities.

3. The railcar energy absorption system according to claim 1, wherein said second follower has a generally T-shaped configuration when viewed from a top thereof.

4. The railcar energy absorption system according to claim 1, wherein a forward end of said second follower is urged toward and engages the a rear end of the housing of the first cushioning assembly.

5. The railcar energy absorption system according to claim 1, wherein the housing of said first cushioning assembly is configured to fit laterally between the pair of center stops.

6. The railcar energy absorption system according to claim 1, wherein an operable overall thickness of said second follower can vary to allow said railcar energy system to be used in various railcars having different size pockets between the front pair of stops and the rear pair of stops.

7. The railcar energy absorption system according to claim 1, Wherein the second cushioning assembly has a combined buff travel of about 7.25 inches and a draft travel of about 4.75 inches limited by the second cushioning assembly.

8. The railcar energy absorption system according to claim 1, wherein the housing of both the first cushioning assembly and the second cushioning assembly each have a closed end and an open end.

9. The railcar energy absorption system according to claim 1, wherein the yoke is movable relative to the housing of both the first cushioning assembly and the second cushioning assembly.

10. An energy absorption system for a railcar having a sill with front stops and rear stops defining an elongated pocket therebetween, with said centersill also having center stops disposed between said front stops and said rear stops, a coupler having a head portion and a shank portion, with the head portion of said coupler axially extending beyond an end of the sill to allow adjacent railcars to be interconnected to each other, with said energy absorption system comprising:

a first cushioning assembly positioned in the sill pocket between the front stops and center stops;

a first follower positioned in the sill pocket and urged toward and engageable with the front stops under the influence of the first cushioning assembly, with said first follower being operably engageable with a free end of the shank portion of the coupler;

a second cushioning assembly positioned in the sill pocket to a rear of the first cushioning assembly between the center stops and rear stops, with said second follower being positioned in the pocket and normally urged toward and configured to engage with the center stops;

an axially elongated yoke encompasses the first and second cushioning assemblies, the yoke terminates in an open forward end and is coupled to the shank portion of the coupler; and wherein the first and second cushioning assemblies act in series relative to each other to absorb and cushion energy directed against them when the energy absorption system operates in a buff direction, and with a second follower acting in concert with the center stops and the second cushioning assembly to reduce movement between adjacent and interconnected railcars when the energy absorption system operates in a draft direction.

11. A method for absorbing energy on a railcar having an axially elongated centersill with a pair of front stops and a pair of rear stops defining an elongated pocket therebetween, with said centersill also having a pair of center stops disposed between said pair of front stops and said rear stops, a coupler having a head portion and a shank portion, with the head portion of said coupler axially extending beyond an end of the centersill, with said method comprising the steps of:

positioning a first cushioning assembly in the pocket of said centersill between the pair of front stops and said pair of center stops, with said first cushioning assembly including a housing, a plunger arranged for axial sliding movements within an open end of said housing, and a resilient spring for consistently urging said plunger toward an extended position relative to said housing;

arranging a first follower in said pocket of said centersill such that said first follower is urged toward and engageable with said front pair of stops under the influence of the first cushioning assembly, with said first follower being operably engageable with a free end of the shank portion of said coupler;

configuring a second cushioning assembly to fit in said pocket of said centersill between said pair of center stops and said pair of rear stops, with said second cushioning assembly including an open-ended housing, a wedge arranged for axial sliding movements within the open-ended housing, a clutch arranged in operable combination with said wedge, and a resilient spring for consistently urging the wedge of said second cushioning assembly toward an extended position relative to the housing of said second cushioning assembly;

arranging a second follower in said pocket such that the second follower is urged toward and configured to engage with said center pair of stops under the influence of the second cushioning assembly;

arranging an axially elongated yoke having a back wall engageable with a rear end of said second cushioning assembly when said energy absorption system operates in a draft direction, with said yoke further including top and bottom walls which extend forwardly from said back wall such that the top and bottom walls of said yoke entrap the first and second cushioning assemblies therebetween and terminate in an open forward end, with the forward end of said yoke being coupled to the shank portion of said coupler, and with a rear wall of the housing of second cushioning assembly operably engaging the back wall of said yoke; and with said first and second cushioning assemblies acting in series relative to each other to absorb and cushion energy directed against them when said energy absorption system operates in a buff direction, and with said second follower acting in concert with said pair of center stops and said second cushioning assembly to allow said second cushioning assembly to minimize excessive system cycles in draft energy events.

12. The method for absorbing energy on a railcar according to claim 11 comprising the further step of:

designing the first and second cushioning assemblies such that they differ in their energy absorption capabilities.

13. The method for absorbing energy on a railcar according to claim 11 further including the step of:

configuring said second follower such that it has a generally T-shape when viewed from a top thereof.

14. The method for absorbing energy in a railcar according to claim 11, further including the step of:

designing the second follower such that a forward end of said second follower engages a rear end of the housing of the first cushioning assembly after the first and second cushioning assemblies are arranged in operable cooperation relative to each other.

15. The method for absorbing energy in a railcar according to claim 11, further including the step of:

using various second followers having varying thicknesses to accommodate railcars having different size pockets between the front pair of stops and the rear pair of stops.

16. The method for absorbing energy in a railcar according to claim 11, further including the step of:

configuring each housing of the first cushioning assembly and the second cushioning assembly with a closed end and an open end.

17. The method for absorbing energy in a railcar according to claim 11, further comprising the step of:

allowing said yoke to move relative to the housing of both the first cushioning assembly and the second cushioning assembly.

18. A method for absorbing energy on a railcar having an axially elongated centersill with a pair of front stops and a pair of rear stops defining an elongated pocket therebetween, with said centersill also having a pair of center stops disposed between said pair of front stops and said rear stops, a coupler having a head portion and a shank portion, with the head portion of said coupler axially extending beyond an end of the centersill so as to allow adjacent railcars to be interconnected to each other, with said method comprising the steps of:

positioning a first cushioning assembly in the pocket of said centersill between the pair of front stops and said pair of center stops such that said first cushioning assembly serves to absorb and dissipate buff and draft forces applied thereto by the shank portion of said coupler, with said first cushioning assembly including a housing, a plunger arranged for axial sliding movements within an open end of said housing, and a resilient spring for consistently urging said plunger toward an extended position relative to said housing;

arranging a second cushioning assembly in combination with said first cushioning assembly for absorbing and dissipating draft forces during operation of said railcar, with said second cushioning assembly fitting in said pocket of said centersill between said pair of center stops and said pair of rear stops, with said second cushioning assembly including a housing, a wedge arranged for axial sliding movements within an open end of said housing, a friction clutch assembly arranged in operable combination with said wedge, and a resilient spring for consistently urging the wedge of said second cushioning assembly toward an extended position relative to the housing of said second cushioning assembly;

arranging a follower in said pocket between said first and second cushioning assemblies, with said follower being urged toward and is configured to engage with said center pair of stops under the influence of the second cushioning assembly;

arranging an axially elongated yoke having a back wall engageable with a rear end of said second cushioning assembly when said energy absorption system operates in a draft direction, with said yoke further including top and bottom walls which extend forwardly from said back wall such that the top and bottom walls of said yoke entrap the first and second cushioning assemblies therebetween and terminate in an open forward end, with the forward end of said yoke being coupled to the shank portion of said coupler, and with a rear wall of the housing of second cushioning assembly operably engaging the back wall of said yoke; and with said first and second cushioning assemblies acting in series relative to each other to absorb and cushion energy directed against them when said energy absorption system operates in a buff direction, and with said follower acting in concert with said pair of center stops and said second cushioning assembly, with said second cushioning assembly functioning independently from the first cushioning assembly to minimize excessive draft travel and better dissipate rebound energy employing friction when said energy absorption system operates in a draft direction.

* * * * *